US005823391A

United States Patent [19]

Klauke et al.

[11] Patent Number: 5,823,391

[45] Date of Patent: Oct. 20, 1998

[54] DUAL CHAMBER FLEXIBLE TUBE DISPENSING PACKAGE AND METHOD OF MAKING

[75] Inventors: Christian W. Klauke; Igor F. Beaufils, both of Toledo, Ohio

[73] Assignee: Owens-Brockway Plastic Products Inc., Toledo, Ohio

[21] Appl. No.: 707,564

[22] Filed: Sep. 4, 1996

[51] Int. Cl.[6] ..... B65O 35/22; B65O 21/02

[52] U.S. Cl. ..... 222/94; 222/129; 220/23.4; 220/424; 220/427; 215/10

[58] Field of Search ..... 222/94, 129; 220/23.4, 220/4.24, 4.27; 215/10, 382, 384

[56] References Cited

U.S. PATENT DOCUMENTS

| | | | |
|---|---|---|---|
| D. 274,309 | 6/1984 | Aldrich . | |
| D. 348,829 | 7/1994 | Hallas . | |
| D. 356,026 | 3/1995 | Iaia et al. . | |
| 1,437,345 | 11/1922 | Marr . | |
| 1,568,160 | 1/1926 | Hibbert . | |
| 2,376,855 | 5/1945 | Hanley . | |
| 2,589,743 | 3/1952 | Snaith . | |
| 2,652,951 | 9/1953 | Esposito et al. . | |
| 2,661,871 | 12/1953 | Huenergardt . | |
| 2,764,309 | 9/1956 | Zelonka . | |
| 2,825,085 | 3/1958 | Ingraham . | |
| 2,890,816 | 6/1959 | Horland . | |
| 3,166,221 | 1/1965 | Nielsen . | |
| 3,335,915 | 8/1967 | Shannon . | |
| 3,347,420 | 10/1967 | Donoghue . | |
| 3,374,917 | 3/1968 | Troy . | |
| 3,581,940 | 6/1971 | Cella . | |
| 3,583,590 | 6/1971 | Ferraro . | |
| 3,613,955 | 10/1971 | Wetherell, Jr. . | |
| 3,673,302 | 6/1972 | Halsall et al. . | |
| 3,729,553 | 4/1973 | Gold et al. . | |
| 3,782,600 | 1/1974 | Columbus . | |
| 3,788,520 | 1/1974 | Dukess | 222/94 |
| 3,876,112 | 4/1975 | Kramer . | |
| 3,955,715 | 5/1976 | Topor . | |
| 3,994,408 | 11/1976 | Belitzky . | |
| 4,065,536 | 12/1977 | Lucas . | |
| 4,165,812 | 8/1979 | Jennison . | |
| 4,381,841 | 5/1983 | Schwarz . | |
| 4,489,839 | 12/1984 | Epperson . | |
| 4,548,322 | 10/1985 | Cullen et al. . | |
| 4,548,606 | 10/1985 | Larkin . | |
| 4,573,595 | 3/1986 | Mednis . | |
| 4,592,478 | 6/1986 | Laconis . | |

(List continued on next page.)

FOREIGN PATENT DOCUMENTS

| | | | |
|---|---|---|---|
| 3514134 | 10/1986 | Germany . | |
| 3616207 | 11/1987 | Germany . | |
| 54-24427 | 2/1969 | Japan . | |
| 55-48973 | 2/1973 | Japan . | |
| 55-161623 | 12/1980 | Japan . | |
| 63-272670 | 11/1988 | Japan | 222/94 |
| 3-162248 | 11/1989 | Japan . | |
| 239665 | 7/1924 | United Kingdom . | |
| 1103534 | 2/1968 | United Kingdom | 222/94 |
| 9105731 | 5/1991 | WIPO . | |

*Primary Examiner*—Andres Kashnikow
*Assistant Examiner*—Keats Quinalty

[57] ABSTRACT

A dual chamber flexible tube dispensing package is formed by providing a pair of plastic parisons, blow molding each parison to form a tube having a rigid finish, a shoulder adjacent the finish and a flexible body extending from the shoulder with a closed lower end; each tube having a generally D-shaped cross section throughout the finish, shoulder and body; each tube having an arcuate wall and a generally flat wall; and bringing the flat walls into abutting relationship. Each tube has a thread such that when the flat walls are in abutting relation, the thread on one tube form continuous thread with the thread of the other tube. In another form of dual chamber dispensing package, each tube has a plurality of vertically spaced integral ribs which extend transversely. The ribs on is one tube are staggered relative to the ribs on the other tube so that when the tubes are brought into engagement, the ribs on one tube engage the ribs on the other tube and the shoulders are in abutment.

15 Claims, 7 Drawing Sheets

U.S. PATENT DOCUMENTS 4,632,268 12/1986 Melzi et al. .
4,640,423 2/1987 Mednis .
4,651,900 3/1987 Horvath et al. .
4,656,840 4/1987 Loofbourrow et al. .
4,666,068 5/1987 Bush .
4,685,565 8/1987 Sparling .
4,687,663 8/1987 Schaeffer .
4,708,253 11/1987 Mednis .
4,713,064 12/1987 Bruno et al. .
4,723,671 2/1988 Mears .
4,770,854 9/1988 Lyman .
4,771,919 9/1988 Ernst .
4,779,764 10/1988 Debetencourt .
4,802,406 2/1989 Bouldin .
4,823,985 4/1989 Grollier et al. .
4,872,557 10/1989 Ames .
4,874,113 10/1989 Schmidt .
4,881,652 11/1989 Schiemann .
4,883,251 11/1989 Manas .
4,925,066 5/1990 Rosenbaum .
4,940,137 7/1990 Straub .
4,964,539 10/1990 Mueller .
4,966,298 10/1990 Holdt .
4,982,858 1/1991 Holdt .
4,984,715 1/1991 Green .
4,989,758 2/1991 Keller .
5,002,199 3/1991 Frahm .
5,007,540 4/1991 Beasley et al. .
5,038,963 8/1991 Pettengill et al. .
5,050,755 9/1991 Strawder .
5,052,590 10/1991 Ratcliff .
5,065,875 11/1991 Balavich .
5,083,679 1/1992 Plough .
5,083,680 1/1992 Plough .
5,101,997 4/1992 Bagwell et al. .
5,114,044 5/1992 Spanek, Jr. .
5,135,702 8/1992 Eales .
5,137,178 8/1992 Stokes et al. .
5,143,261 9/1992 Drobish .
5,152,432 10/1992 De Laforcade .
5,158,191 10/1992 Douglas et al. .
5,158,209 10/1992 Reil et al. .
5,167,349 12/1992 Rodder et al. .
5,186,559 2/1993 Fu .
5,213,235 5/1993 Miranda .
5,223,245 6/1993 Ibrahim et al. .
5,236,108 8/1993 House .
5,244,120 9/1993 O'Meara .
5,251,106 10/1993 Hui .
5,259,505 11/1993 Sobel .
5,269,441 12/1993 O'Meara .
5,271,536 12/1993 Wilson .
5,316,159 5/1994 Douglas et al. .
5,316,398 5/1994 Chandaria et al. .
5,318,203 6/1994 Iaia et al. ..... 222/94
5,356,040 10/1994 Reggiani .
5,381,916 1/1995 Strawder .
5,386,928 2/1995 Blette ..... 222/94
5,392,947 2/1995 Gentile .

DUAL CHAMBER FLEXIBLE TUBE DISPENSING PACKAGE AND METHOD OF MAKING

This invention relates to dual chamber flexible tube dispensing packages wherein each of the tubes is adapted to be filled with a different viscous material and then simultaneously dispensed by simultaneously squeezing the tubes.

BACKGROUND AND SUMMARY OF THE INVENTION

It has heretofore been suggested that two flexible tubes can be brought together to form a dual flexible tube package, as shown for example, in U.S. Pat. Nos. 3,782,600, 4,687,663, 5,052,590, 5,244,120, 5,269,441, and 5,318,203.

In U.S. Pat. No. 5,318,203, there is disclosed the concept of utilizing elongated hollow flexible tubes, each of which has an upper end and lower end wherein the upper end is D-shaped and the lower end is round or oval shaped. The upper ends of the tubes are attached to a coupling which is joined to a dispensing base. The coupling has two exit orifices, one for each tube. The dispensing base includes two nozzles which are inserted into the two orifices.

Among the objectives of the present invention are to provide a dual flexible tube package which will effectively segregate active ingredients in the respective tubes; which is more readily manufactured; which is more readily filled; and which is more readily sealed.

In accordance with the invention the dual chamber flexible tube dispensing package comprises two substantially identical tubes that are mirror images of one another, except for the finishes. Each tube includes a rigid half finish, a rigid half shoulder and a flexible tubular body extending from the shoulder. The cross sections of the half finish, half shoulder and body of each tube are D-shaped such that each has a flat portion and all the flat portions are in a single plane. The two tubes have the flat portions in abutting relation to one another such that the dual tube package has a finish defined by the two half finishes, a shoulder defined by the two half shoulders and a dual chamber body defined by the two flexible tube bodies. The threads on the half finishes are located thereon such that when the two tubes are brought into abutting relation a continuous thread is formed on the finish. The resultant dual chamber flexible tube packages are then filled with the respective viscous materials and the open ends are sealed to complete the package. In another form of dual chamber dispensing package, each tube has a plurality of vertically spaced integral ribs which extend transversely. The ribs on one tube are staggered relative to the ribs on the other tube so that when the tubes are brought into engagement, the ribs on one tube engage the ribs on the other tube and the first portions of the shoulders are in abutment. Each rib is convex outwardly when viewed in transverse cross section.

The dual chamber flexible tube dispensing packages are formed by providing a pair of plastic parisons, blow molding each parison to form a container having a rigid half finish, a rigid half shoulder adjacent the finish and a flexible body extending from the shoulder to a rigid closed lower end. The rigid closed end of each container is cut-off to produce the two tubes. The flat portions of the two tubes are then brought into abutting relationship such that when the flat walls of the two tubes are in abutting relation, the thread on the half finish on one tube forms a continuous thread with the thread of the half finish on the other tube. This results in the dual chamber flexible tube dispensing package. The overall cross section of the resultant finish is cylindrical. The overall cross sectional configurations of the shoulder and flexible body are generally oval or round with the major axis at ninety degrees to the abutting flat portions.

DESCRIPTION OF THE PREFERRED EMBODIMENT

Figure 1:
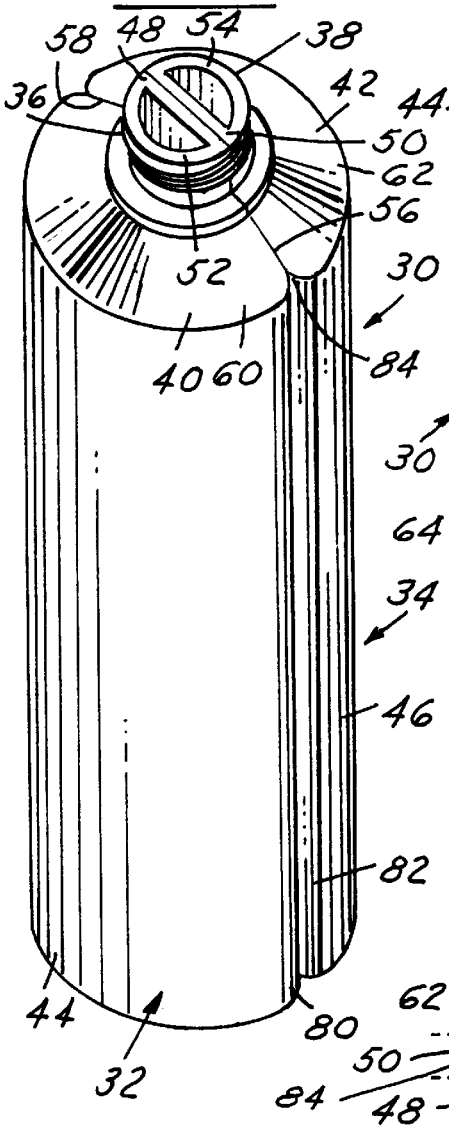
FIG. 1 is a perspective view of a dual chamber flexible tube dispensing package embodying the invention before being filled.
Figure 2:
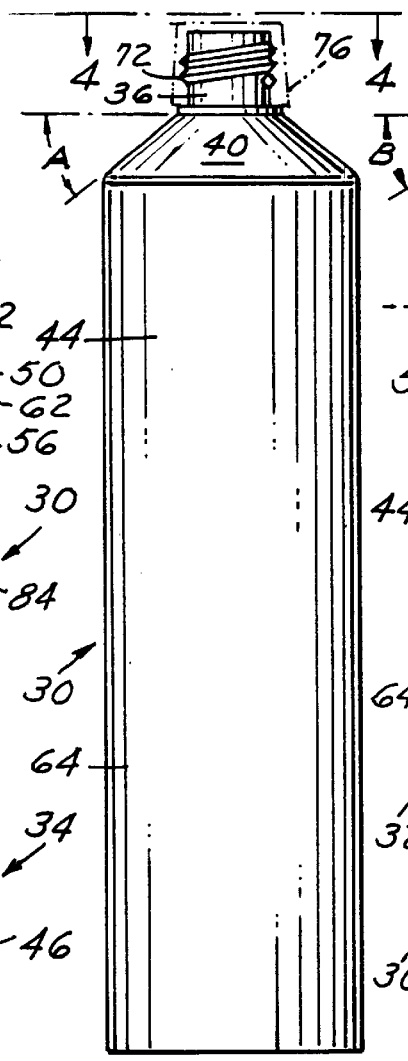
FIG. 2 is a front elevational view of the package shown in FIG. 1.
Figure 3:
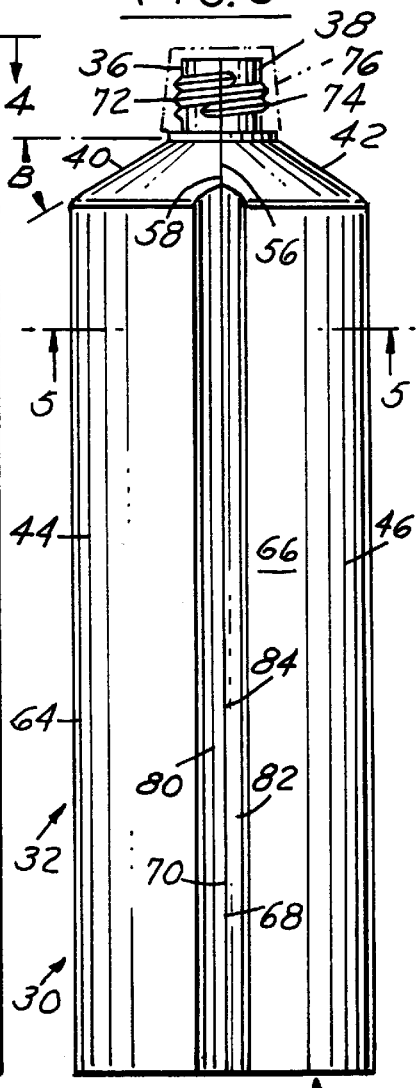
FIG. 3 is a side elevational view of the package shown in FIG. 1.
Figure 4:
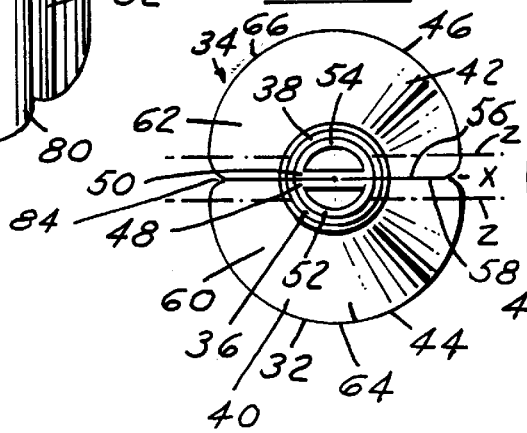
FIG. 4 is a top plan view taken along the line 4—4 in FIG. 1.
Figure 5:
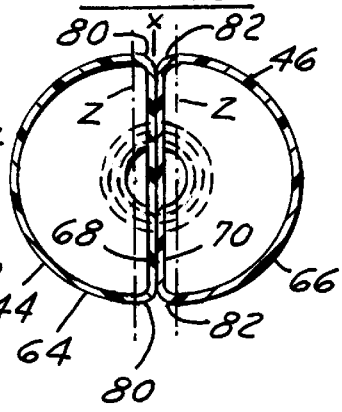
FIG. 5 is a bottom part sectional plan view taken along the line 5—5 in FIG. 3.
Figure 6:
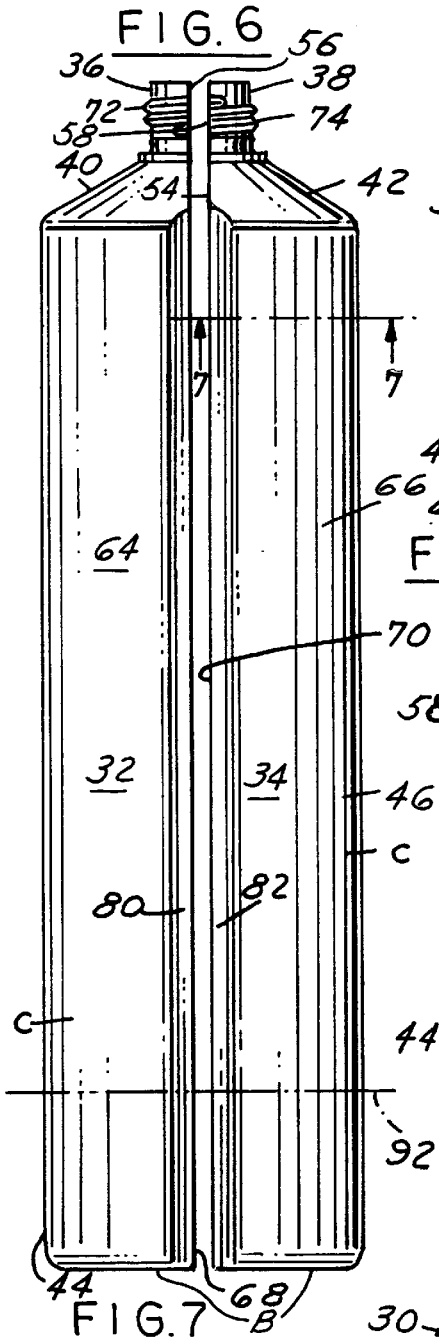
FIG. 6 is an elevational view of the package shown in FIG. 1 showing the two containers after being blow molded which are used to make the tubes.
Figure 8:
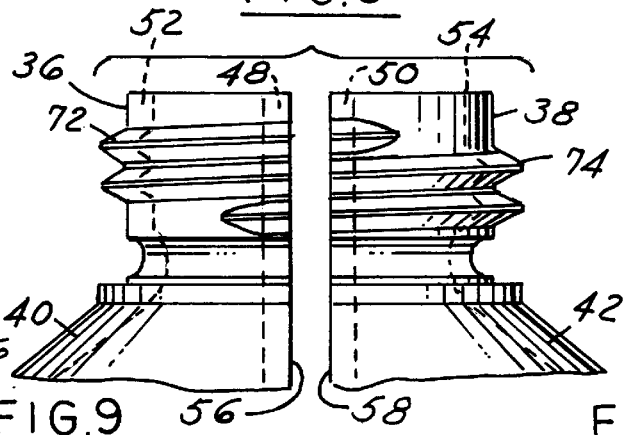
FIG. 8 is a fragmentary view on an enlarged scale of the upper end of two containers shown in FIG. 6.
Figure 9:
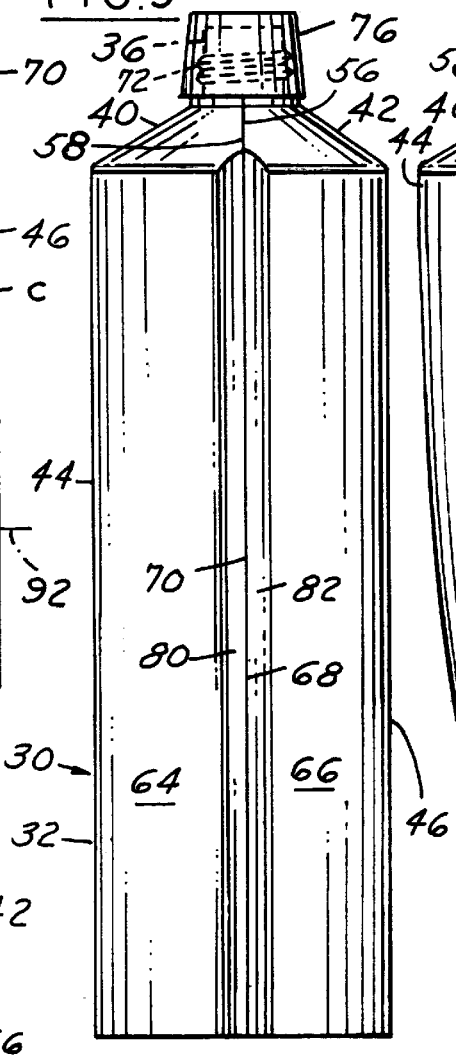
FIG. 9 is an elevational view similar to FIG. 3 showing the package being filled and the lower ends of the tubes sealed and including a closure on the package.
Figure 10:
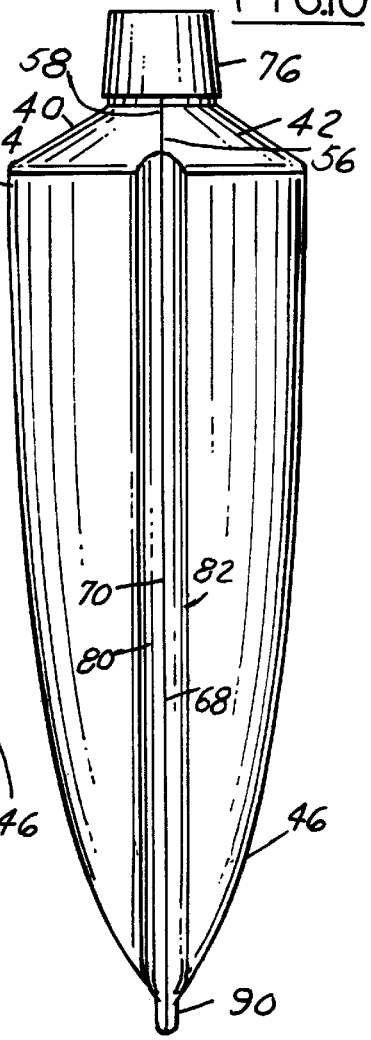
FIG. 10 is an elevational view similar to FIG. 9 showing the package after being filled and sealed.
Figure 7:
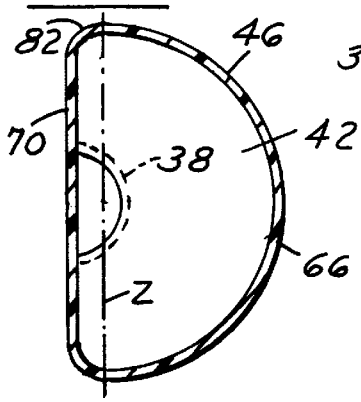
FIG. 7 is a sectional view taken along the line 7—7 in FIG. 6.

Referring to FIGS. 1–5, the dual chamber flexible tube dispensing package 30 embodying the invention comprises two plastic tubes 32, 34 which are in abutting relation to one another. Each tube 32, 34 is a mirror image of the other except for the threads, as presently described. Each tube 32, 34 includes a rigid half finish 36, 38, an integral rigid half shoulder 40, 42, and an integral thin flexible body 44, 46. The finish 36, 38, shoulder 40, 42 and body 44, 46 of each tube 32, 34 have flat surfaces abutting one another. As shown in FIG. 4, each half finish 36, 38 is generally D-shaped in cross section including a flat portion 48, 50 and an integral interconnecting wall extending from the ends of the flat wall portions 48, 50 to define an opening in each finish 36, 38 herein shown as an arcuate portion 52, 54. Each shoulder portion 40, 42 includes a flat portion 56, 58 and an arcuate portion 60, 62. Each tube body 44, 46 includes a arcuate wall portion 64, 66 and a flat wall portion 68, 70. As shown in FIGS. 1–3 and 5, the lower end of each body 32, 34 is open to provide for access for filling of the tubes 32, 34. Means are provided on the exterior of the half finish 36, 38 for interengaging a closure. As shown in FIGS. 2, 3 and 6, the means comprises a thread 72 on the half finish 36 and a thread 74 on the half finish 38 such that when the flat wall portions 48, 50 are in abutting relation, a continuous thread is provided for the package which may receive a conventional threaded closure 76 (FIGS. 9, 10). Similarly, when the half finishes 36, 38 are in abutting relation, the flat portions 48, 50 form a double wall (FIG. 4). When the shoulder portions 40, 42 are in abutting relation, the flat portions 56, 58 define a double wall. The flat wall portions 68, 70 are in abutting relationship as shown in FIG. 5 to define a double wall.

As further shown in FIGS. 1, 3, 4 and 5, the flat wall portions 68, 70 of each tube body 44, 46 are joined to the curved portions 44, 46 by curved portions 80, 82 along the edges of the flat portions 68, 70 such that an axial groove 84 is provided between each edge of the adjacent bodies 44, 46. As a result, the diametral width of the flat portions 68, 70 is less than the diametral width along the line X at the axial extremities of the arcuate wall portions 44, 46. The side walls of the grooves 84 are concave in radial cross section. The grooves 84 makes the package aesthetically more pleasing, and also facilitates handling, assembly and final sealing to close the open ends of the tubes. The overall cross section of the resultant finish is cylindrical. The overall cross sectional configurations of the shoulder and flexible body are generally oval or round with the major axis at ninety degrees to the abutting flat portions. The radius of the arcuate portions 44, 46 taken from the mold line X is constant.

In the preferred forms, the tubes 32, 34 are held in assembled relation by a closure 76. Alternatively, the two tubes 32, 34 can be bonded along the flat wall portions by a strip of adhesive, a plurality of adhesive areas or by sonic welding through the open ends along the flat wall portions.

After each tube 32, 34 is filled, the lower ends of the tubes are sealed by crimping and fusing by various commercially available methods (as at 90 in FIG. 10).

Each of the tubes 32, 34 is made from a plastic parison and blow molded in accordance with well known procedures to form a hollow container C (FIG. 6) which is then cut along a line 92 to provide the respective tube. The blow molding is done by any one well known blow molding methods such as extrusion blow molding, injection extrusion blow molding and injection molding a parison and blow molding the parison. In each instance, a parison is formed and blow molded. Preferred methods are extrusion blow molding and injection extrusion blow molding.

The containers and resultant tubes 32, 34 may be made of monolayer parisons or multilayer parisons depending on the viscous materials that are to be packaged. A satisfactory monolayer plastic parison is linear low density polyethylene. A satisfactory multilayer plastic extruded parison is one having an inner layer of low density polyethylene; an adhesive layer; a layer of ethylene vinyl alcohol; an adhesive layer; a layer of container regrind alone or including virgin low density polyethylene or polyethylene and colorant; and an outer layer of low density polyethylene alone or mixed with high density polyethylene and colorant.

In order to make the tubes of the present invention, the center line of each half finish is radially spaced from the parting line along the line Z (FIGS. 4, 5). In addition the acute angle formed on the outer surface of each shoulder 40, 42 changes circumferentially such that the angle A (FIG. 2) adjacent grooves 84 is greater than the angle B at ninety degrees to the grooves 84 or at the axial midpoint of arcuate wall portions 48, 50 (FIGS. 3 and 4).

Figure 11:
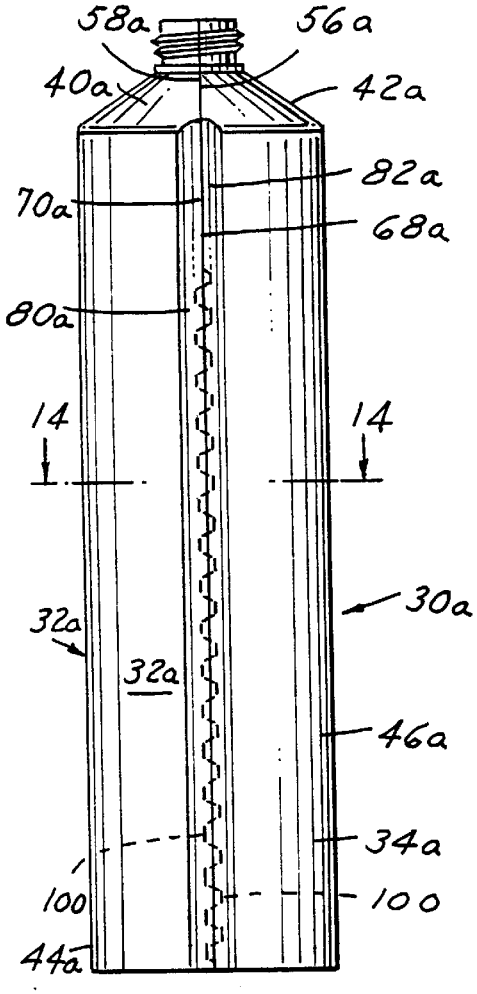
FIG. 11 is a side elevational view of a modified form of package before being filled.
Figure 12:
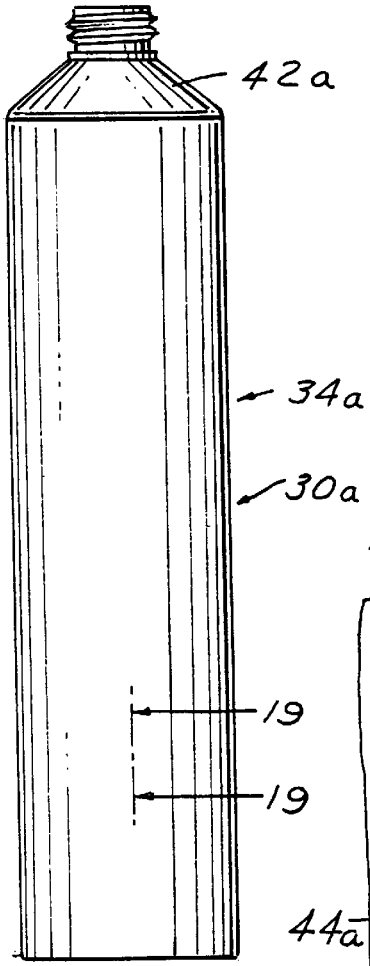
FIG. 12 is a front elevational view of the package shown in FIG. 10.
Figure 14:
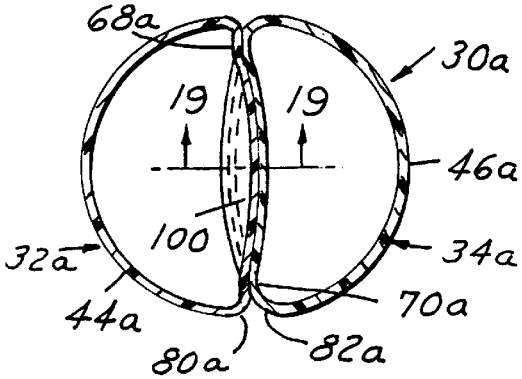
FIG. 14 is a sectional view taken along the line 14—14 in FIG. 11.
Figure 16:
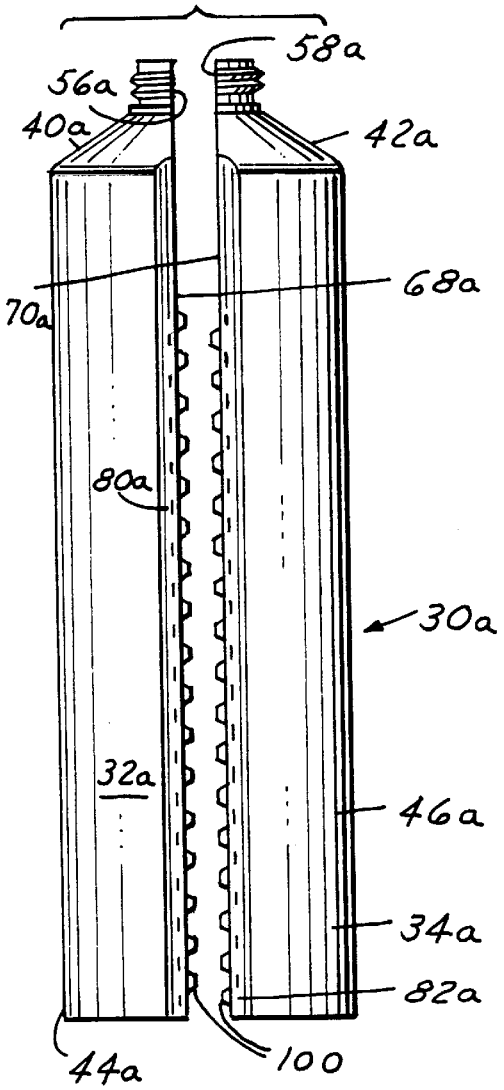
FIG. 16 is a side elevational view of the package shown in FIG. 11 showing two tubes side-by-side before assembly.
Figure 18:
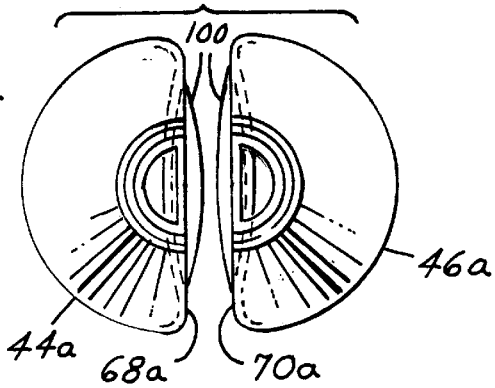
FIG. 18 is a top plan view of the package shown in FIG. 16.
Figure 17:
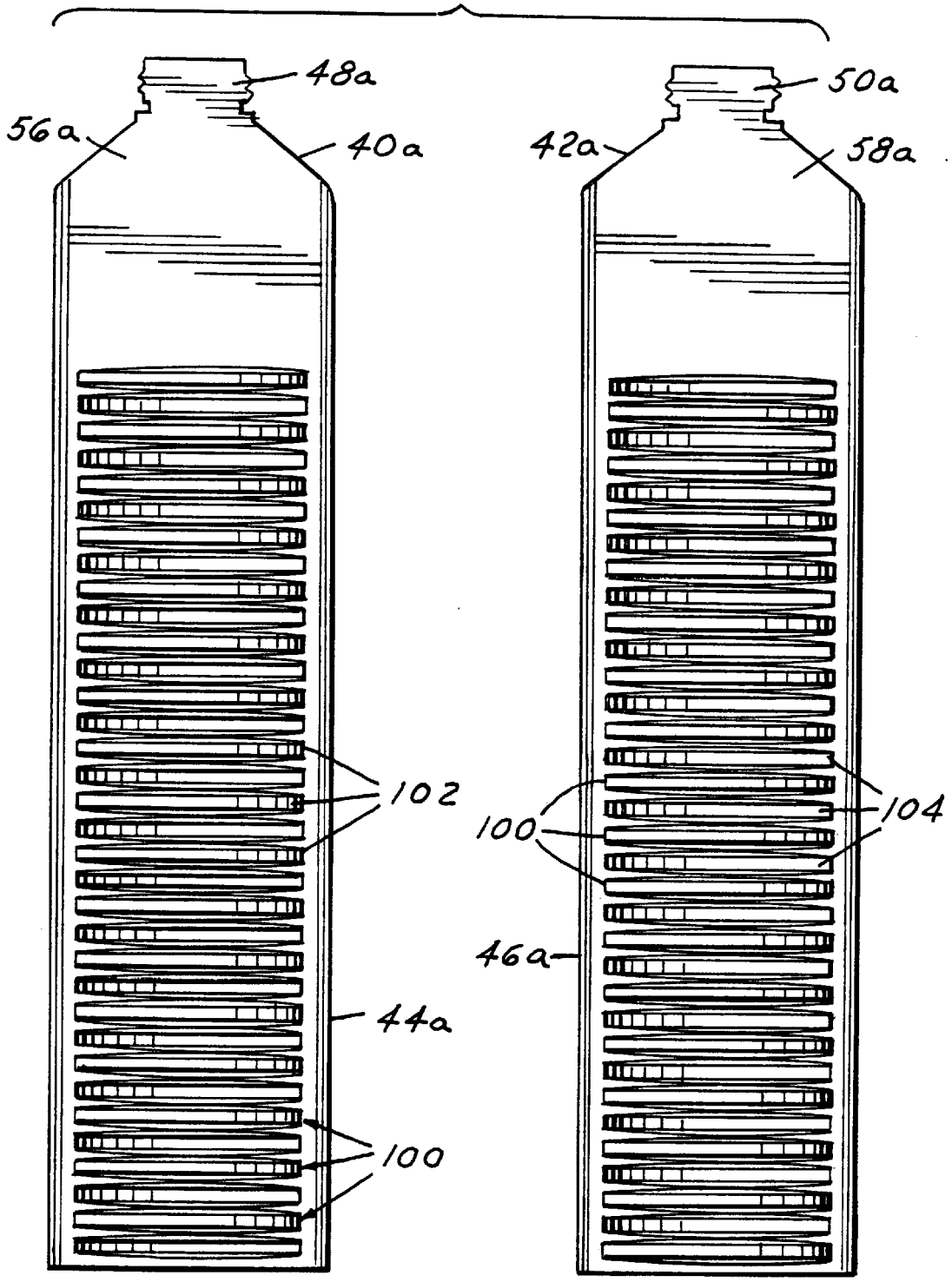
FIG. 17 is a side-by-side view of the two tubes.

In the modified form of package shown in FIG. 11–20, the two tubes 32*a*, 34*a* of the dual tube dispensing package are identical except for the flat wall portions (and the threads). For convenience, similar portions are identified with the suffix "a". The flat portions 68*a*, 70*a* of each tube body 44*a*, 46*a* are provided with a plurality of vertically spaced integral ribs 100 (FIGS. 16–20) which extend transversely. As shown in FIGS. 11 and 16, the ribs 100 on one tube are staggered relative to the ribs 100 on the other tube so that when the tubes are brought into engagement, the ribs 100 on one tube engage the ribs 100 on the other tube and the flat portions 56*a*, 58*a* of the shoulder 40*a*, 42*a* are in abutment (FIG. 11). Each rib 100 is convex outwardly when viewed in transverse cross section as shown in FIGS. 14 and 18.

Figure 19:
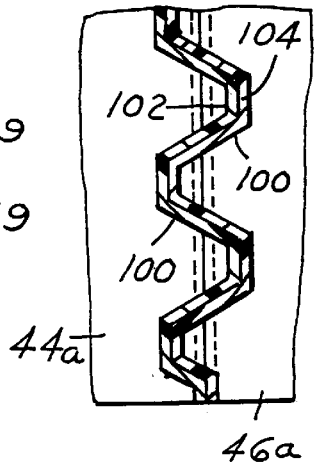
FIG. 19 is a fragmentary sectional view taken along the line 19—19 in FIG. 12.
Figure 13:
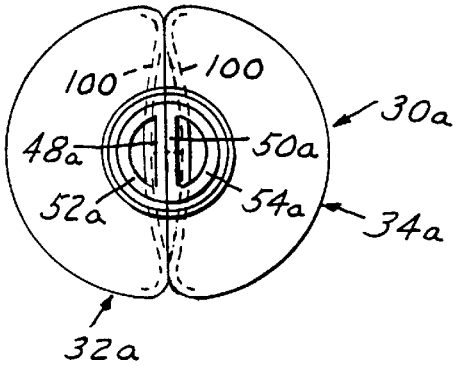
FIG. 13 is a top plan view of the package shown in FIG. 11.
Figure 20:
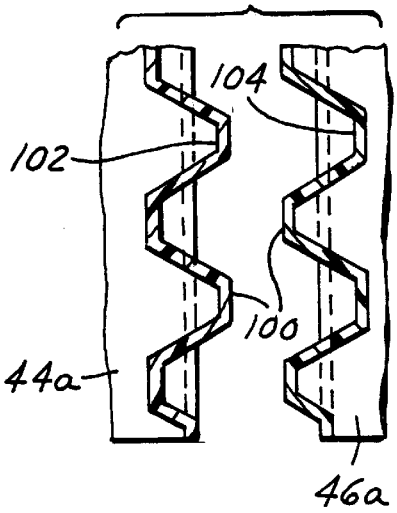
FIG. 20 is a fragmentary sectional view similar to FIG. 19 showing portions of the tubes before assembly.
Figure 15:
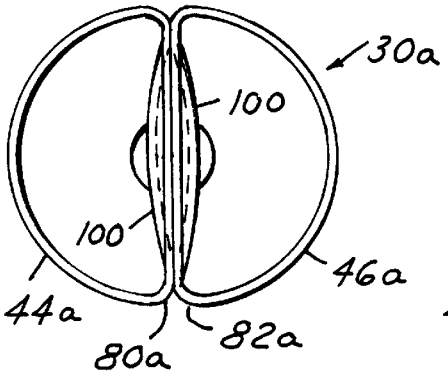
FIG. 15 is a bottom plan view of the package shown in FIG. 11.

Preferably, adhesive is applied on one or more of the flat portions of the tubes, for example, along the flat portion of the shoulder portions 40*a*, 42*a*. In addition, the apex 102 of each rib 100 (FIG. 20) is flattened for engagement with an intervening groove 104 of the other tube (FIGS. 19, 20).

Among the advantages of this form of the invention are ease of assembly and better filling and sealing line characteristics and is effective in maintaining the cross sectional configuration of the package including the D-shape.

Figures 21, 22, 23:
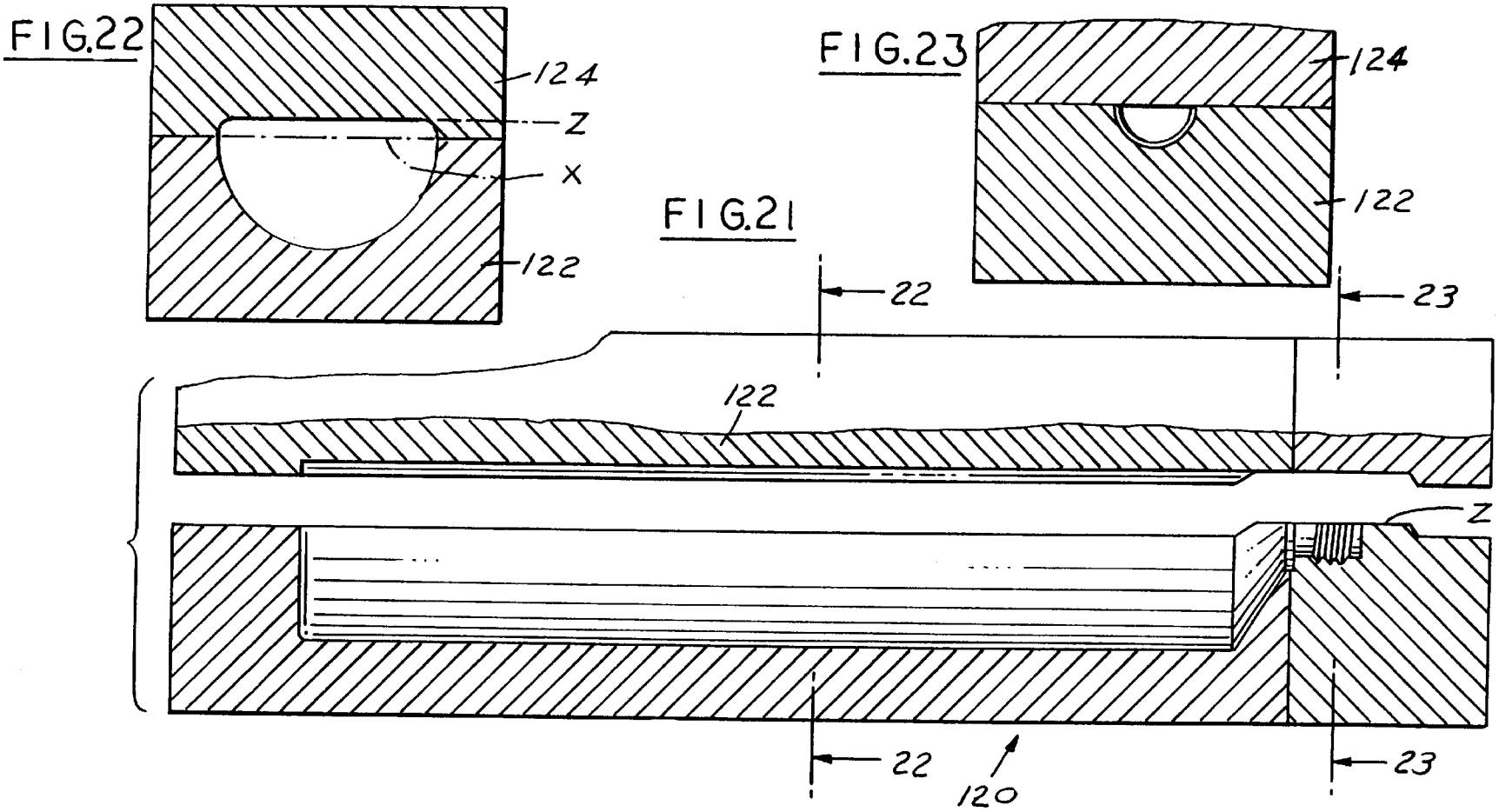
FIG. 21 is a part sectional partly schematic view of a mold utilized in making a container from which a tube for the package is made by blow molding.
FIG. 22 is a sectional view taken along the line 22—22 in FIG. 21.
FIG. 23 is a sectional view taken along the line 23—23 in FIG. 21.

FIGS. 21–23 are views of a mold for blow molding a parison to make one of the containers from which one of the tubes 32, 34 is made. The mold comprises mold halves 120, 122 which define the cavity. It can be seen that the mold line X defined by the two mold halves in the portion of the molds which define the body of the tube is displaced radially from the mold line or the center line Z of the half finish forming portion and shoulder forming portion of the mold half.

Further, it is desired to label or decorate the package and such labeling can be applied to the containers or the tubes before or after they are assembled to form the package. The labeling may be of well known methods including in-mold labeling of the containers, heat activated labels, pressure sensitive labels, shrink wrap labels on the package and offset labels.

Figure 24:
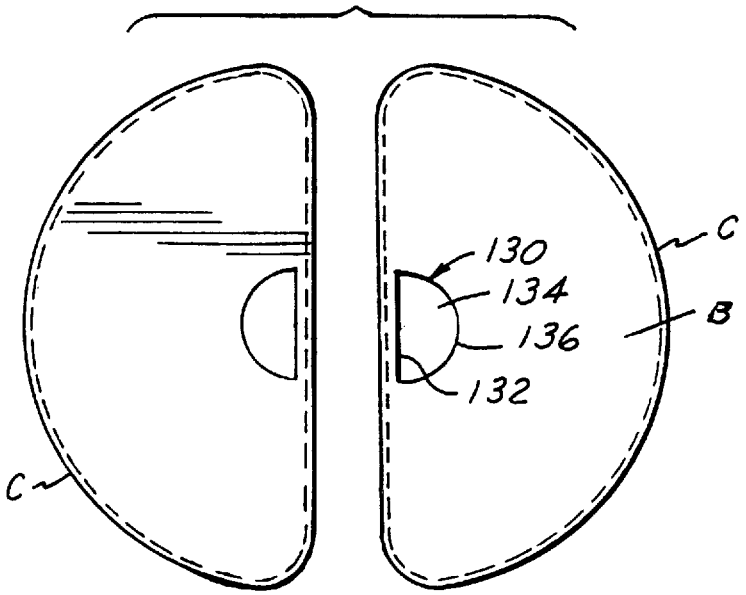
FIG. 24 is a bottom plan view of the side-by-side container shown in FIG. 6.
Figure 25:
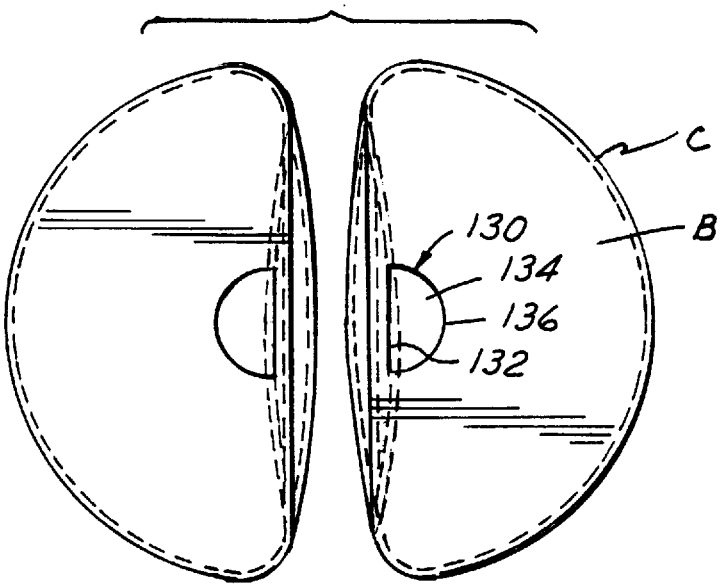
FIG. 25 is a bottom plan view of the side-by-side container shown in FIG. 16 before the bottom ends are cut off.

Referring to FIGS. 24 and 25, in each of the forms of the invention, each container C is formed with a depression recess 130 on the base wall B. Each recess 130 includes a diametral shoulder 132 parallel to the flat walls and an inwardly tapered surface 134 that extends from an apex 136 from the surface of the base to the shoulder 132 and is arcuate in cross section. The recesses 130 provide engaging surfaces for rotating each container as may be desired by engaging the finish of the container with a chuck and the base of the container with a chuck having a lug for engaging the recess 130. In addition, the recesses 130 may be similarly utilized for engagement of the two containers when they are brought together before severing.

Among the advantages of the dual chamber flexible tube dispensing package are the following;

1. Maintaining the contents of the two tubes isolated by a double wall until they are dispensed from the finish.

2. The ability to make one tube from a monolayer parison and the other tube of a multilayer parison where a multilayer and more costly parison is required for the contents of one of the tubes only.

3. The ability to have a different internal diameter opening on the half finish of one tube than the internal diameter opening of the other tube thereby controlling the amount of the contents of the respective tubes when the two tubes are squeezed.

4. The package is more readily manufactured and sealed.

5. The package can be manufactured and assembled at higher speeds and lower costs.

It can thus be seen that there has been provided a dual flexible tube package which will effectively segregate active ingredients in the respective tubes; which is more readily manufactured; which is more readily filled; and which is more readily sealed.

What is claimed is:

1. A dual chamber dispensing package comprising:

pair of plastic tubes, each said tube comprising a rigid finish, a shoulder adjacent to the finish and a thin flexible body extending from said shoulder, said finish, said shoulder and said body of each said flexible tube having a generally flat wall and an integral interconnecting wall extending from said flat wall, said flat wall of each said tube body having a plurality of axially spaced transversely extending integrally formed ribs, said flat walls being in abutting relation with the ribs on one tube nesting between adjacent ribs on the other tube.

2. The dual chamber dispensing package set forth in claim 1 including means on each said integral finish defining means for interengaging a closure.

3. The dual chamber dispensing package set forth in claim 2 wherein each said finish, each said shoulder and each said body of each said flexible tube is generally D-shaped in cross section.

4. The dual chamber dispensing package set forth in claim 3 wherein said means on the finish for interengaging said closure comprises thread means thereon such that when the flat walls are joined, said thread means on one tube forms continuous thread means with the thread means of the other said tube.

5. The dual chamber dispensing package set forth in claim 4 wherein the lower ends of each said tube opposite said finish are open for filling.

6. The dual chamber dispensing package set forth in claim 4 wherein said tubes are filled and the lower ends of said tubes are sealed to one another.

7. The dual chamber dispensing package set forth in claim 1 wherein each said rib has a flat apex that abuts the wall between the ribs on the opposing tube.

8. The dual chamber dispensing package set forth in claim 7 wherein each said rib is convex outwardly in transverse cross section.

9. The dual chamber dispensing package set forth in claim 8 including adhesive applied to at least one of said pairs of walls.

10. A dual chamber dispensing package that comprises:

a pair of plastic tubes each having a rigid finish, a rigid shoulder integrally extending from said finish, and a thin flexible body integrally extending from said shoulder, said finish, said shoulder and said body each being D-shaped in cross section having coplanar flat walls, with said flat walls of said tubes being in abutting relation, said finishes having external means that form a continuous external thread when said tubes are in abutting relation, each said finish comprising a continuous wall having a flat portion forming said flat wall and a cylindrical portion on which said external means are disposed, said flat and cylindrical portions of the finishes forming D-shaped openings into the associated tubes, and a closure externally threaded over said finish closing said openings.

11. The dual chamber dispensing package set forth in claim 10 wherein said flat walls of said body of each tube are provided with axially spaced transversely extending ribs, the ribs on one tube nesting between ribs on the other tube.

12. The dual chamber dispensing package set forth in claim 10 wherein the lower end of each said tube opposite said finish is open for filling.

13. The dual chamber dispensing package set fort in claim 10 wherein said tubes are filled and the lower end of said tubes are sealed to one another.

14. The dual chamber dispensing package set forth in claim 10 wherein each said tube comprises a single layer of plastic.

15. The dual chamber dispensing package set forth in claim 14 wherein at least one of said tubes comprises multiple layers of plastic.

* * * * *